United States Patent [19]

Larsen

[11] Patent Number: 4,756,407

[45] Date of Patent: Jul. 12, 1988

[54] CONTAINER APPARATUS FOR MEDICINAL TABLETS

[76] Inventor: Ernest F. Larsen, 2544 E. Holmes Ave., Mesa, Ariz. 85204

[21] Appl. No.: 132,808

[22] Filed: Dec. 14, 1987

[51] Int. Cl.[4] ..... B65D 83/04

[52] U.S. Cl. ..... 206/37; 206/528; 206/540; 215/364; 220/410

[58] Field of Search ..... 206/530, 540, 37, 528; 215/304; 220/352, 358, 293, 408, 410, 403

[56] References Cited

U.S. PATENT DOCUMENTS

| | | | |
|---|---|---|---|
| 2,892,595 | 6/1958 | Tupper | 206/540 |
| 3,151,740 | 10/1964 | Simon | 206/530 |
| 3,367,484 | 2/1968 | Nelson | 206/540 |
| 3,844,407 | 10/1974 | Buie | 206/530 |
| 4,420,076 | 12/1983 | Beveridge et al. | 206/540 |
| 4,538,731 | 9/1985 | Cillario | 206/540 |

*Primary Examiner*—Joseph Man-Fu Moy
*Attorney, Agent, or Firm*—H. Gordon Shields

[57] ABSTRACT

Container apparatus for medicinal tablets includes a generally cylindrical housing and a bore in the housing for receiving medicinal tablets in a stacked, orderly arrangement so that the tablets are able to move laterally only a minimum amount so that minimum pulverizing of the tablets occurs in common usage. The housing also includes insulation features for insulating the tablets so that the tablets are maintained at a relatively constant temperature. A cap is secured to the housing, and the cap includes provisions for transporting the container apparatus and for fastening the container to a key ring, or the like.

3 Claims, 1 Drawing Sheet

CONTAINER APPARATUS FOR MEDICINAL TABLETS

BACKGROUND OF THE INVENTION

1. Field of the Invention

This invention relates to containers, and more particularly, to containers for medicinal tablets used to transport tablets required by a user.

2. Description of the Prior Art

Tablets are typically contained in tablet containers in which the tablets are either separated from each other in packets which may be either square, rectangular, or circular, with a packet containing a plurality of individual receptacles, each of which includes a single tablet. A sealing element, such as foil, etc., is placed on the container and the tablets are individually sealed in their compartments. By removing only a single tablet at a time, the other tablets in the container maintain their sealed status. Such an arrangement is, obviously, very bulky. In addition, there is relatively little protection for the individual tablets. For example, if the package is placed in a woman's purse or in a man's pocket, the sealing foil, or whatever is used, is relatively easily torn, etc., so that the tablets are subject to pulverizing, falling out, etc.

In the alternative, tablets may be inserted into a hard, outer shell, such as a plastic container. The tablets have no protection from each other, and accordingly may be chipped or broken by ordinary movements.

In addition to the other problems, as discussed above in the preceding paragraphs, such apparatus offers virtually no protection against temperature problems. Tablets, at least for some medicinal purposes, require temperatures within a predetermined range in order to maintain their potency. If temperatures exceed the desired range, a degradation in the chemical or medicinal properties of the tablets results. This is so with nitroglycerin tablets taken for angina problems.

Prior art containers for nitroglycerin tablets normally do not include any insulative features for the tablets. Accordingly, the temperature of the tablets rapidly stabilizes at ambient temperatures, whatever that may be. In some climates, such as the southern and southwestern portions of the United States, where temperatures may exceed 100° Fahrenheit on summer days, it is obvious that the temperature of the nitroglycerin tablets, when subjected to such temperatures, without insulative protection, will quickly reach the outside ambient temperature.

The apparatus of the present invention overcomes the deficiencies of the prior art by providing a tablet container which limits the extent of the pulverizing which may occur and which provides insulation for protecting the tablets from degradation due to the temperature problems.

U.S. Pat. No. 322,144 (Williams) discloses a milk and water cooler which includes a pair of coaxial cylinders, one disposed within the other. The two cylinders are spaced apart by braces. The two cylinders have separate lids and separate spouts.

U.S. Pat. No. 624,168 (Brun) discloses a portable refrigerating case having three separate compartments, the innermost of which contains the frozen goods. The middle compartment includes a liquid cooling medium, and the outer compartment holds insulating material.

U.S. Pat. No. 1,670,864 (Martin) discloses a container including cylindrical elements, spaced apart from each other, with corrugated spacers between them. The inner container holds frozen materials, and between the inner container and the outer container are various types of insulation, corrugated spaces, and the like. The inner container is separated from the outer container also by a particular cap configuration and by a bottom configuration.

U.S. Pat. No. 1,851,512 (Hinkley) discloses a double milk bottle container which is a housing for holding a pair of milk cartons. The housing includes spaced apart walls, with the space between the walls comprising dead air space. The two walls are connected together by spacer ribs. The connecting ribs apparently extend the full width of the cylinders.

U.S. Pat. No. 2,538,059 (Strunk) discloses insulation system for a vessel in which there are two concentric vessels with the outer vessel being a relatively cylindrical vessel and the inner vessel being generally cylindrical but with a grid configuration on its outer periphery or protrusions extending outwardly from the outer periphery and contacting the inner periphery of the outer vessel. Dead air spaces are formed between the two vessels within the grid opening.

U.S. Pat. No. 3,632,311 (Sullivan) discloses an insulated container used for the delivery of frozen foods. There are inner and outer vessels or shells, with corrugated insulating material and dead air space between the inner and outer walls.

U.S. Pat. No. 3,088,634 (Rosenkrans et al) patent discloses a tablet retainer cage which comprises a pair of cylinders, with the inner cylinder holding the tablets and being spaced apart from the outer cylinder. The inner cylinder contains apertures connecting the inner cylinder with a space between the inner and outer cylinders.

U.S. Pat. No. 3,246,789 (Progler) discloses a rectangular storage container for liquified gases. The structure includes thermal insulation as an outer housing, and a plurality of discrete seals on the inside of the thermal insulation covering for holding an inner gas having a low thermal conductivity for insulation purposes.

U.S. Pat. No. 3,338,238 (Warncke) discloses a pressure gas storage container and safety breathing apparatus having a plurality of compartments. Some of the compartments communicate with each other, and some do not.

U.S. Pat. No. 3,365,099 (McTaggart) discloses a tablet dispenser apparatus for holding a plurality of tablets. The apparatus is generally cylindrical in configuration and is designed to hold a supply of tablets for a predetermined time, such as one month, etc. The tablet dispenser includes calendar indicia, etc. The cylindrical apparatus includes window elements for allowing a visual inspection of the contents of the apparatus.

U.S. Pat. No. 4,054,208 (Lowe) discloses a medicinal tablet container including a pair of cylindrical containers, or a double walled insulated container, in which the two containers, or container walls, are separated from each other. The outer container is preferably glass, and the inner container may be either glass or plastic.

U.S. Pat. No. 4,129,228 (Stoneback) discloses a medication container which has essentially two portions, a bottom cylindrical portion and a top cylindrical cap portion. Medication is disposed on the inside of the lower cylindrical portion. The cap portion is secured by a chain to a user's body. A cap portion is relatively large and is threadedly secured to the lower portion. The primary reason for the size of the cap is to allow it to be quickly removed from the bottom portion. Because it is so large it is easily gripped or held by a user, making it easy to remove it to allow the user to easily and quickly obtain access to the medication.

U.S. Pat. No. 4,374,571 (Hirvela) discloses a scent dispenser comprising a pair of elements threadedly secured together, with a removable scent holder nested within one of the two elements. The particular structural design of the two elements, as they are threadedly secured together, is claimed in detail.

U.S. Pat. No. 4,420,076 (Beveridge et al) discloses a pill container adapted to be work by a user. The apparatus includes a cylindrical holder, with a removable plug type bottom and a removable plug type top. The cylindrical container does not include insulation elements. Rather, the significant design aspect of the '076 patent appears to reside in the plug configuration for the top or upper plug.

SUMMARY OF THE INVENTION

The invention described and claimed herein comprises a container for medicinal tablets having a bore slightly greater than the diameter of the tablets so as to minimize pulverizing action due to random movement of the tablets within the container, and which includes insulative properties to protect the tablets against temperature variations.

Among the objects of the present invention are the following:

To provide new and useful medicinal tablet container apparatus;

To provide new and useful container apparatus for medicinal tablets having an easily removed cap;

To provide new and useful container apparatus having insulation features for protecting the tablets against temperature variations;

To provide new and useful tablet container apparatus easily opened to provide access to tablets contained therein; and To provide new and useful container apparatus for medicinal tablets which minimizes pulverizing action of the tablets by random motion of the tablets.

DESCRIPTION OF THE PREFERRED EMBODIMENT

Figure 1:
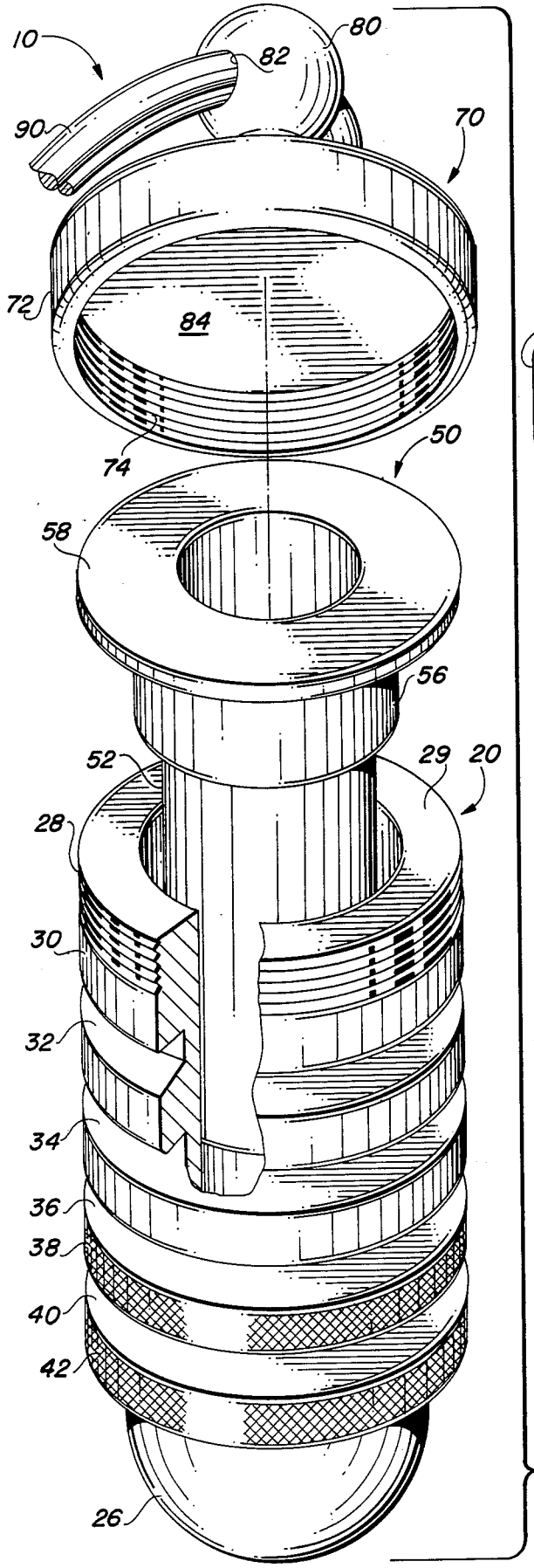
FIG. 1 is an exploded perspective view of the apparatus of the present invention.
Figure 2:
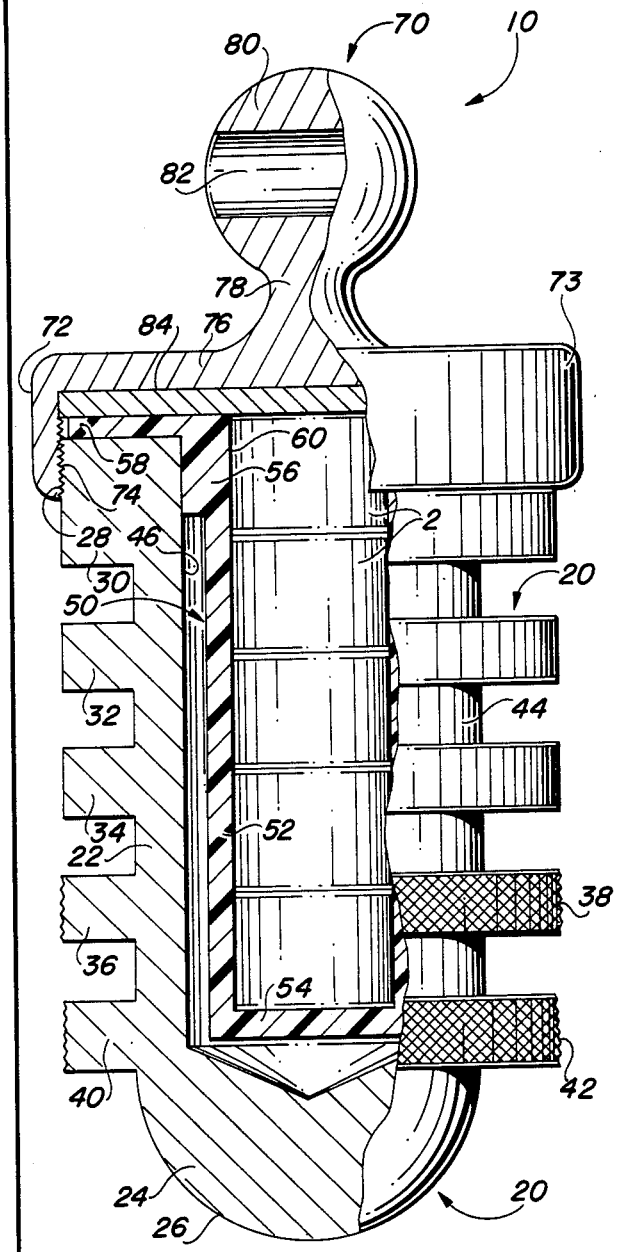
FIG. 2 is a view in partial section through the assembled apparatus of the present invention.

FIG. 1 is an exploded perspective view of container apparatus 10 embodying the present invention. FIG. 2 is a sectional view of the assembled container apparatus of FIG. 1. The container apparatus 10 includes, generally, a housing 20, a cylindrical insert 50 disposed within the housing 12, and a cap 70 which threadedly engages the housing 20 to secure the apparatus together. For convenience in carrying the apparatus 10, and also to aid in removing the cap 70 from the housing 20, a ring 90 extends through a portion of the cap 70. A plurality of medicinal tablets 2 are shown within the insert 50 in FIG. 2. For the following discussion, reference will be made to FIGS. 1 and 2 in discussing the container apparatus 10.

The housing 20 comprises a metallic shell, preferably of aluminum with hard anodizing on both the inside and the outside of the housing. The housing 20 includes a cylinder 22 with a lower portion 24 and an externally threaded upper portion 28. The lower portion 24 includes a convexly rounded bottom 26. A relatively flat top surface 29 is adjacent to the threaded portion 28. The top surface 29 is generally perpendicular to the longitudinal axis of the housing 20.

Between the bottom 24 and the externally threaded upper portion 28 are a plurality of outwardly extending flanges or fins. The fins or flanges act as heat radiating elements to help keep heat away from the cylinder 22. In the drawing there are shown five such flanges or fins. They include a flange 30, a flange 32, a flange 34, and a flange 40. The lower two flanges, flanges 36 and 40, include knurled outer surfaces. The fin or flange 36 includes a knurled outer surface 38 and the flange or fin 40 includes a knurled outer surface 42. The knurled surfaces 38 and 42 preferably extend on the full or outer peripheral surfaces of the fins 36 and 40, respectively. The purpose of the knurled outer surfaces 38 and 42 is for helping a user hold and grasp the housing 20 in order to remove the cap 70 to have access to the medicinal tablets disposed within the insert 50.

Between the flanges 30 . . . 40, the cylinder 22 comprises a smooth, cylindrical inter-flange portion 44, as best shown in FIG. 2. That is, the outer periphery of the cylinder 22 is generally smooth, as best shown in FIG. 2, with the flanges 30 . . . 40 extending radially outwardly with respect to the longitudinal access of the cylinder 22. In essence, the smooth outer periphery comprises the bottom portions of parallel grooves defined between or with the radially outwardly extending flanges 30 . . . 40.

The interior of the shell housing 22 comprises a relatively smooth longitudinally extending bore 46. The insert 50 extends into the bore 46. The insert 50 is preferably made of an inert plastic material, such as polypropylene. The insert 50 includes a cylindrical portion 52 with a closed bottom wall 54. The bottom wall 54 is substantially perpendicular to the cylindrical portion 52, or to the longitudinal axis of the cylindrical portion 52.

At the upper portion of the cylinder 52 is a thickened wall portion 56. The axial length of the thickened wall portion 56 is relatively short, with respect to the overall length of the cylinder 52. At the top of the thickened wall portion 56 is an outwardly extending flange or lip 58. The lip 58 is disposed on the top or upper portion 29 of the cylinder 22, adjacent to the externally threaded portion 28.

The outer diameter of the thickened wall portion 56 is slightly greater than the inner diameter of the bore 46. This results in a force fit, or interference fit, between the housing 20 and the insert 50 when the insert 50 is assembled to the housing 20. The interference fit between the insert 50 and the housing 20 insures that the insert 50 remains within the bore 26 of the housing 20, and provides a seal between the housing 20 and the insert 50 to insure that the space between the bore 26 of the housing 20 and the insert 50 beneath the thickened wall portion 56 remains as insulative dead air.

As best shown in FIG. 2, there is a substantial space between the outer periphery of the insert 50 and the bore 46 of the housing 20. This space comprises dead airspace which helps to prevent thermal conductivity between the housing 20 and the insert 50, and specifically between the housing 20 and the medicinal tablets disposed within the inset 50.

Within the insert 50 is an internal bore 60. The diameter of the bore 60 is slightly greater than the medicinal tablets 20 disposed within the insert 50. The difference between the diameter of the bore 60 and the outer diameter of the tablets 2 is sufficient to allow the tablets 2 to be put into and removed from the insert 50 without difficulty, but the differences in diameter renders it virtually impossible for the tablets 2 to break, scrape, etc. Accordingly, the tablets 2 should always be easily loaded or inserted into the insert 50 and should similarly be easily removed from the insert 50 upon demand.

The cap 70 has a cylindrical portion 72, which is of a relatively short height, and an end wall 46. The cylindrical portion 72 includes internal threads 74 which are adapted to matingly engage the threaded portion 28 of the housing 20.

Above the cylindrical portion 72 is a neck 78, the neck 78 comprises a transition from the end wall portion 76 to an upper portion 80 of the cap. A bore or aperture 82 extends through the upper portion 80 of the cap 70. A ring 90 extends through the aperture or bore 82.

Within the cylindrical portion 72, and disposed against the end wall 76 of the cap 70, is an insert 84. The insert 84 is a multifunctional element. The insert 84 acts as a gasket or sealing element between the housing 12 and the cap 40, and it also acts as a cushion for the tablets 2 disposed within the bore 60. The presence of the insert 84 also acts as an additional insulator for the tablets disposed within the bore 60.

In FIG. 2, a plurality of tablets 2 is shown disposed in the bore 60 of the insert 50. It will be obvious that the container apparatus 10 maybe dimensionally configured as desired for virtually any desired tablets in terms of both diameter and length. That is, while five tablets are shown in FIG. 2, and the five tablets 2 are shown as the approximate diameter of the bore 34, and are of a height so that the bore 34 would be substantially filled with the five tablets, it is obvious that container apparatus 10 may be dimensioned in terms of both length and diameter to accommodate any type and number of tablets desired.

The knurled surfaces 38 and 42 of the housing fins 36 and 40 are for frictional purposes to enhance the usability of the container apparatus 10 for a person having dexterity problems for any of a variety of reasons, such as arthritis, or other health related constraints, such as attempting to remove a nitroglycerin tablet from the container apparatus 10 at the onset of an angina attack. A user may grasp the knurled portion 14 of the housing 12 in one hand, with the knurled portion comprising a frictional enhancement area on the container apparatus 10. The other hand of the user may grasp the ring 90 to facilitate the unthreading of the cap 70 from the threads or threaded portion 20 of the housing 20.

The cylindrical portion 72 of the cap 70 includes an outer peripheral surface 73. The outer peripheral surface 73 may be knurled, similar to the knurled portions 38 and 42, of the housing 20, if desired. The purpose of the knurled outer surface would be, of course, to enhance the frictional engagement of a user's hands and fingers with the cap 70 as an aid in quickly removing the cap 70 from the housing 20.

On the other hand, the purpose of the relatively large upper portion 80, with its bore 82 and a relatively large ring 90, which extends through the bore 82, is to provide a relatively large element or elements that a user may quickly grasp as an aid in removing the cap 70 from the housing 20.

In case of angina attacks, and when nitroglycerin tablets comprise the tablets 2 disposed within the bore 60 of the insert 50, speed is vitally important in providing the user access to the tablets 2. At the same time, a vital ingredient with respect to the speed is the ease with which the cap 70 and the housing 20 may be separated to provide access to the tablets 2. Accordingly, the easier the cap 70 is to grasp, and the easier the housing 20 is to grasp, the easier and faster a user will have access to the tablets 2 within the insert 50.

It will be noted that, for all practical purposes, the insert 50 is substantially suspended within the bore 46 of the housing 20. That is, dead air space is provided for substantially the entire length of the cylinder 52 and between the bottom end wall 54 of the insert 50. The insert contacts the housing 20 only at the upper portion of the bore 26 by virtue of the thickened wall portion 56, and at the top or top surface 29 of the cylinder 22 and the flange 58 of the insert 50. The insert 84 of the cap 70 presses downwardly on the flange 58 to insure a seal between the cap 70 and the insert 50 with respect to the housing 20.

With the dead air space between the insert cylinder 52 and the bore 46 of the cylinder 22, the tablets 52 are well insulated from heat regardless of the environment in which the apparatus 10 is placed. In addition, the fins 30 . . . 40 extend outwardly to help radiate or conduct heat away from the cylinder 22, and the space between the fins 30 . . . 40 provides for the circulation of air about the peripheral surface 44 to insure heat radiation away from the cylinder 22 so that the cylinder 22 does not become a heat sink for absorbing heat. Rather, the housing 20 acts as a radiator to help the insert 50 and the tablets 2 therein to keep relatively cool under virtually all circumstances.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Container apparatus comprising, in combination:

housing means, including a first cylindrical portion, including a bottom, a plurality of flanges extending outwardly from the first cylindrical portion, a first bore having a first diameter within the cylindrical portion, and fastening means remote from the bottom;

cylindrical insert means for holding a plurality of medicinal tablets, including a second cylindrical portion having an outer diameter which is less than the first diameter to provide a space between the first bore of the housing means and the second cylindrical portion and about the cylindrical insert means within the housing means, a bottom wall disposed apart from the bottom of the first cylindrical portion to provide space between the bottom wall and the bottom of the first cylindrical portion, and which space comprises a continuation of the space about the cylindrical insert means with the housing means, a top flange disposed on the first cylindrical portion of the housing means, thickened wall means on the second cylindrical portion having an outer diameter slightly greater than the first diameter of the first bore to provide an interference fit between the housing means and the insert means to secure the insert means to the housing means and to provide a seal for the housing means and the cylindrical insert means for the space about the insert means within the housing means, and a second bore within the second cylindrical portion for holding the medicinal tablets; and cap means securable to the housing means including a first portion adapted to be secured to the housing means, a second portion comprising a closure for the second bore of the second cylindrical portion of the insert means, and a third portion adapted to be used to remove the cap means from the housing means.

2. The apparatus of claim 1 in which the cap means further includes second insert means in the first and second portions for contacting the top flange of the cylindrical insert means and for urging the top flange against the first cylindrical portion of the housing means to provide a further seal for the housing means and the cylindrical insert means.

3. The apparatus of claim 1 in which the third portion of the cap means includes a neck portion secured to the second portion, an upper portion connected to the neck portion, and ring means extending through the upper portion for securing the container apparatus to a user and for providing a relatively large element for grasping by the user in removing the cap means from the cylinder means.

* * * * *